United States Patent [19]

Abom et al.

[11] Patent Number: 4,621,775

[45] Date of Patent: Nov. 11, 1986

[54] HIGH-SPEED MILL FOR GRINDING BIOMASS AND LIKE MATERIAL

[76] Inventors: Jan Åbom, Poppelgatan 12, S-421 74 Västra Frölunda; Bengt Törnqvist, Banérgatan 3, S-114 56 Stockholm, both of Sweden

[21] Appl. No.: 306,636

[22] Filed: Sep. 28, 1981

[30] Foreign Application Priority Data

Oct. 16, 1980 [SE] Sweden ..... 8007266

[51] Int. Cl.[4] ..... B02C 13/282; B02C 18/16

[52] U.S. Cl. ..... 241/86.1; 241/88.1; 241/299

[58] Field of Search ..... 241/221, 242, 294, 243, 241/299, 241, 300.1, 292.1, 88.1, 86.1

[56] References Cited

U.S. PATENT DOCUMENTS

| | | | |
|---|---|---|---|
| 1,212,159 | 1/1917 | Ware | 241/300.1 X |
| 1,412,793 | 4/1922 | Pardee | 241/242 X |
| 2,595,810 | 5/1952 | Perry . | |
| 2,912,176 | 11/1959 | Jordan | 241/242 X |
| 3,762,256 | 10/1973 | Frantz | 241/243 X |
| 3,827,643 | 8/1974 | Arybe et al. | 241/221 |
| 3,888,426 | 6/1975 | Urschel et al. | 241/221 UX |
| 3,904,138 | 9/1975 | Maier et al. | 241/221 X |
| 3,989,196 | 11/1976 | Urschel | 241/299 |
| 4,000,860 | 1/1977 | Gotham | 241/242 |
| 4,355,766 | 10/1982 | Wigand | 241/241 X |

FOREIGN PATENT DOCUMENTS 583590 1/1977 Switzerland .

*Primary Examiner*—Mark Rosenbaum

*Attorney, Agent, or Firm*—Beveridge, DeGrandi & Weilacher

[57] ABSTRACT

A high-speed mill comprises a stationary ring-shaped head for clamping cutting plates thereto and an impeller borne inside the ring-shaped head, said impeller consisting of a rotor with fixed straight vanes and being adapted to bring about rotation of the material to be ground. According to this invention each cutting plate has at its cutting edge a plurality of successive chip-breaking cutting blades disposed in spaced relationship, and said cutting blades in adjacent cutting plates clamped in the head are laterally displaced relative to each other.

13 Claims, 8 Drawing Figures

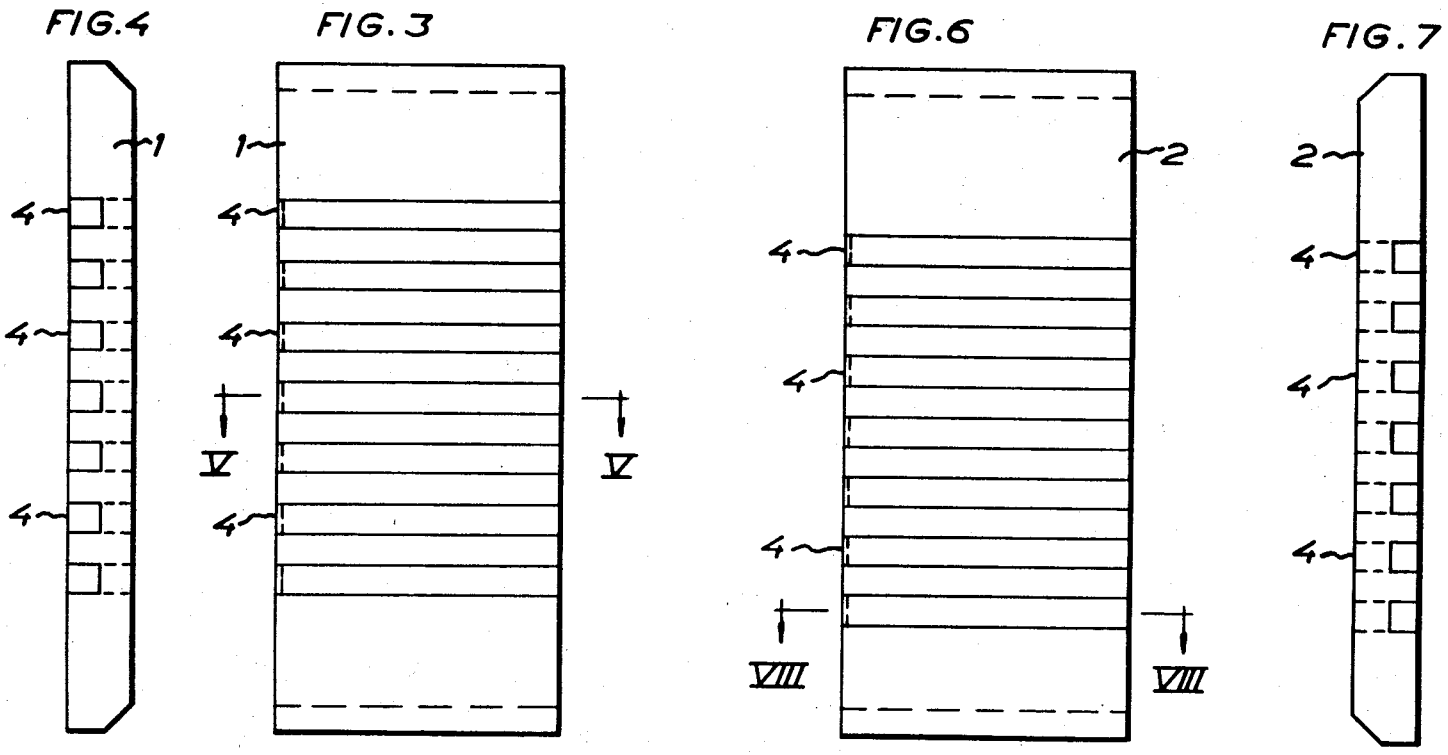
FIG. 7
2
4
4
4
FIG. 6
2
VIII
4
4
4
VIII
FIG. 3
V
1
4
4
V
4
FIG. 4
1
4
4
4
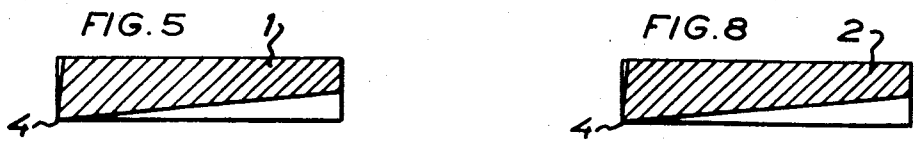
FIG. 8
2
4
FIG. 5
1
4

HIGH-SPEED MILL FOR GRINDING BIOMASS AND LIKE MATERIAL

The present invention relates to a high-speed mill comprising a stationary ring-shaped head for clamping cutting plates thereto and an impeller borne inside the ring-shaped head, said impeller consisting of a rotor having fixed straight vanes and being adapted to bring about rotation of the material to be ground. Thus, the high-speed mill is, for instance, of the type marketed under the name Urschel Comitrol.

The object of the present invention is to provide fine grinding of biomass of loose tree varieties, reeds, straw, peat and soybean husks and bushes so as to obtain a fine powder. Also other materials may come in question, such as the rubber of tyres and the like, which must be in frozen condition during the grinding process. Novel and characteristic of the invention is that each cutting plate has at the cutting edge a plurality of successive chip-breaking cutting blades disposed in spaced relationship and that the chip-breaking cutting blades in adjacent cutting plates clamped in the head are laterally displaced relative to each other. Only by this arrangement of the chip-breaking cutting blades has it been possible to grind the material into powder, which has not been possible by means of prior-art cutting plates having the entire knife edge at the cutting edge. The powder of the biomass is intended for use, for one thing, as fuel in detached-house type boilers and fast diesel engines in which the powder particle size is to be 0–125$\mu$.

The invention will be described in more detail below with reference to the accompanying drawings which illustrate the principle of the mill according to the invention and show the configuration of a set of cutting plates therefor.

In the drawings,

FIG. 3 is a front view of a cutting plate included in one of the sets;

FIG. 4 is a side view of the cutting place of FIG. 3;

FIG. 5 shows the cutting plate in cross-section on line V—V in FIG. 3;

FIG. 6 is a front view of a cutting plate included in the other set;

FIG. 7 is a side view of the cutting plate of FIG. 6; and

FIG. 8 shows the cutting plate in cross-section on line VIII—VIII in FIG. 6.

Figure 1:
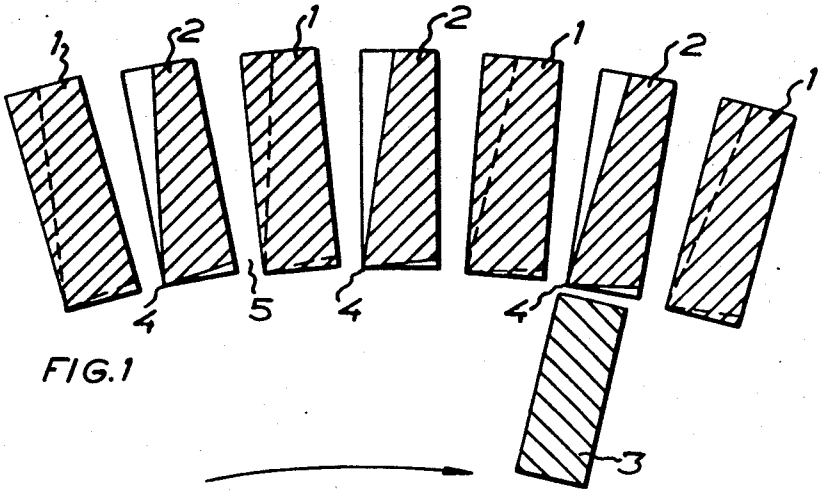
FIG. 1 shows a cross-section of some of the cutting plates clamped to the head, and one of the fixed vanes of the impeller.

The high-speed mill comprises a stationary ring-shaped head for clamping the cutting plates 1 and 2 thereto and an impeller which is concentrically borne inside the ring-shaped head. The impeller consists, more exactly, of a rotor having a number of evenly distributed fixed straight vanes 3 which may be, say, five in number. The head may consist of two rings adapted to be tightened and cooperating with holder rings, provided with teeth, for the cutting plates 1 and 2. The impeller is adapted to bring about rotation of the material to be ground so that this will be subjected to machining by means of the cutting plates 1 and 2. The rotation of the impeller is illustrated by the arrow in FIG. 1.

According to the invention each cutting plate 1 and 2 has at the cutting edge a plurality of successive chip-breaking cutting blades 4 disposed in spaced relationship. The cutting plates 1 and 2 are adapted to be placed alternately after each other in the head so that the chip-breaking cutting blades 4 in adjacent cutting plates 1 and 2 clamped in the head are laterally displaced relative to each other.

In the preferred embodiment shown the chip-breaking cutting blades 4 have at the cutting edge the same width as the distance between them, said cutting blades 4 in adjacent cutting plates 1 and 2 being displaced sideways or laterally by one cutting width relative to each other. Preferably the width of the chip-breaking cutting blades 4 is about 1 mm and, consequently, also according to the embodiment shown the distance between them is about 1 mm.

Other proportions between the width of the straight chip-breaking cutting blades 4 and the distance between them are also conceivable. Thus, the width of the cutting blades 4 might be twice the distance between the cutting blades, in which case the set of cutting plates should contain three different types of plates for reasons of symmetry.

Figure 2:
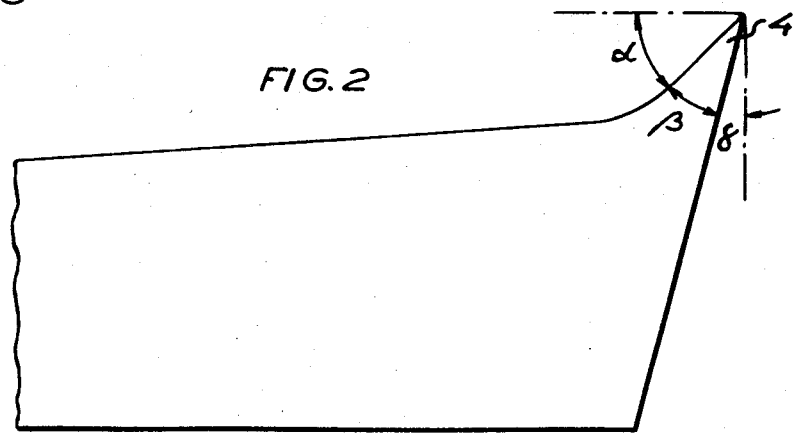
FIG. 2 shows on an enlarged scale a preferred embodiment of the chip-breaking cutting blade.

The configuration of the preferred embodiment of the chip-breaking cutting blade 4 appears from FIG. 2, where the angle $\alpha$ represents the rake, $\beta$ the cutting or tool angle and $\delta$ the angle of clearance. Thus, $\alpha=45°$, $\beta=30°$ and $\delta=15°$. However, as the cutting plates 1 and 2 must consist of carbide or other metal of comparable hardness and abrasive resistance it may be necessary to modify the angles of the cutting blade 4 so as to obtain the strength required.

The size of the mill may of course vary within wide limits but a common measure of the internal diameter of the head would be about 200 mm. The cutting plates 1 and 2 should be as close as possible relative to each other. Thus, the gap 5 between the cutting plates 1 and 2 at their ends facing the impeller should be very narrow, preferably about 0.02 mm. The circumferential speed should be between 96 and 96 m/sec, since this gives a favourable consumption of power, which presupposes that the ground article has a moisture content below 40%.

The invention is not limited to that described above and shown in the drawings but may be modified within the scope of the appended claims.

What we claim and desire to secure by Letters Patent is:

1. A high speed mill for grinding biomass and like material, comprising, a rotary impeller having vane means, said vane means being movable in a path which imparts rotary motion to the material which is to be ground, a plurality of cutting plates disposed adjacent to the path of the vane means for cutting material which is moved thereagainst by the vane means, each of said cutting plates having a cutting edge which faces toward the path of the vane means, said cutting edge comprising a plurality of chip-breaking cutting blades, each of said cutting blades having a sharpened edge portion which extends transversely with respect to the path of the vane means, said cutting blades on each said cutting plate being spaced from each other in a direction which is sideways with respect to the path of the vane means, said cutting blades of adjacent cutting plates being displaced relative to each other in a direction which is sideways with respect to the path of the vane means.

2. A high speed mill according to claim 1 wherein the chip-breaking cutting blades are substantially rectangular.

3. A high speed mill according to claim 1 wherein the entire cutting edge formed by said blades lies in a straight line which extends across each said cutting plate.

4. A high speed mill according to claim 1 wherein said cutting blades have a cutting width of about 1 mm.

5. A high speed mill according to claim 1 wherein the cutting plates have ends facing the path of the impeller which are spaced apart by narrow gaps of about 0.02 mm.

6. A high speed mill according to claim 5 wherein said cutting blades having a cutting width of about 1 mm.

7. A high speed mill according to claim 1 wherein, on each said cutting plate, each of said cutting blades has a cutting width which is substantially equal to the distance between said cutting blades on said cutting plate.

8. A high speed mill according to claim 7 wherein said cutting widths are about 1 mm.

9. A high speed mill according to claim 7 wherein the cutting plates have ends facing the path of the impeller which are spaced apart by narrow gaps of about 0.02 mm.

10. A high speed mill according to claim 9 wherein said cutting widths are about 1 mm.

11. A high speed mill for grinding biomass and like material, comprising, an impeller which is rotatable about an axis of rotation, said impeller having vane means which moves in a path which imparts rotary motion to the material which is to be ground, a plurality of cutting plates disposed adjacent to the path of the vane means for cutting material which is moved thereagainst by the vane means, each of said cutting plates having a cutting edge which faces toward the path of the vane means, said cutting edge comprising a plurality of chip-breaking cutting blades, each of said cutting blades having a sharpened edge portion which extends transversely with respect to the path of the vane means, said cutting blades on each said cutting plate being spaced from each other in a direction which is parallel to said axis of rotation, said cutting blades of adjacent cutting plates being displaced relative to each other in a direction which is parallel to said axis of rotation.

12. A high speed mill according to claim 11 wherein the chip-breaking cutting blades are substantially rectangular.

13. A high speed mill according to claim 11 wherein the entire cutting edge formed by said blades lies in a straight line which extends across each said cutting plate.

* * * * *